US006089371A

United States Patent [19]

Lin

[11] Patent Number: 6,089,371

[45] Date of Patent: Jul. 18, 2000

[54] PLASTIC PALLET AND SEPARATOR FOR PACKAGING YARN SPOOLS

[75] Inventor: Allen Fong-Chin Lin, Taipei, Taiwan

[73] Assignee: Nan Ya Plastics Corporation, Taiwan

[21] Appl. No.: 09/332,992

[22] Filed: Jun. 15, 1999

Related U.S. Application Data

[62] Division of application No. 09/140,895, Aug. 27, 1998.

[51] Int. Cl.[7] ..... B65D 85/66

[52] U.S. Cl. ..... 206/394; 206/391; 206/392

[58] Field of Search ..... 206/386, 392, 206/394, 597, 497, 391

[56] References Cited

U.S. PATENT DOCUMENTS

| | | | |
|---|---|---|---|
| 4,142,634 | 3/1979 | Leff et al. | 206/392 |
| 4,580,680 | 4/1986 | Wind | 206/392 |
| 4,865,202 | 9/1989 | Day | 206/597 |
| 4,890,743 | 1/1990 | Powel et al. | 206/392 |
| 4,998,619 | 3/1991 | Sowa et al. | 206/394 |
| 5,423,428 | 6/1995 | Selz | 206/597 |
| 5,551,563 | 9/1996 | Allen | 206/394 |
| 5,809,904 | 9/1998 | Darby | 206/394 |

*Primary Examiner*—David T. Fidei
*Attorney, Agent, or Firm*—Bacon & Thomas PLLC

[57] ABSTRACT

A construction for the packaging of plastic separators having top, middle and bottom plates formed of single plastic moldings. Each of the plates have support plugs for positioning one or more yarn spools sandwiched between the top plate and the middle plate, the top plate and the bottom plate, or the middle plate and the bottom plate. Wrapping film (22) covers the yarn spools sandwiched between the plates. The top and bottom plates each include deep grooves (13, 20) with widths larger than that of the packaging rope. The packaging rope is arranged along the grooves tor secure the yarn spools between the plates. The bottom plate includes at least four corners with upper rims (23) and bottom rims (24). The upper rims (23) are more projected than the bottom rims (24). The rims are configured as fixing parts for the wrapping film (22) that extends from the top plate to the bottom plate.

1 Claim, 16 Drawing Sheets

PLASTIC PALLET AND SEPARATOR FOR PACKAGING YARN SPOOLS

This application is a Division of nonprovisional application Ser. No. 09/140,895 filed Aug. 27, 1998 pending.

BACKGROUND OF THE INVENTION

1. Field of the Invention

This invention relates to a device for supporting yarn spools during package shipment and storage, constructed by plastic pallets and plastic separators comprises the supporting plugs of bobbins and the top or base pallet, the middle separator or the bottom pallet, to combine together as a whole for separating bobbins from each other.

2. Description of the Related Art

At present, the yarn spool once formed by polyester winding required to be packaged for storage and shipment. For this purpose, it adopts pallets operation, where in the pallets can accommodate multi-stacking yarn spool. With the top, middle and bottom supporting plugs set in the paper tube, we can stack the yarn spools safely. Traditional yarn spools stack more unstable and easily collapisble because the round cap shape plugs which contact with each other on the top surface, and there fore causes to be unstable and space comsuming while storage and shipment.

Moreover, in the recycling use of these round cap shape plugs, people after take off the said plugs to be separated delivery with the corrugated carton sheet, for saving of the shipment space, and later, reassemble at factory for reuse. This repeated process of taking off and reassembling consequently results in the damage and short life of separate plates, and increasing the labour hours.

To further explain the function of prior arts for supporting plugs and separators during package process, here will describe it with FIG. 1 which is an assembly drawing between traditional supporting plugs and corrugated carton pallet: FIG. 1A, top view of assembly and package on pallets: FIG. 1B, side view of yarn spool on pallets during assembly and package, where in (1) is the pallet for stacking and shipment; (2) is yarn spool (ex. FIG. 1 shows 6 yarn spools each layer, however, it doesn't mean that the numbers of spool are limited to be 6 in this invention); (3) is the paper tube forming from the winding of yarn spool; (4) is the prior art of middle supporting plug of yarn spool, and all the structures are shown as FIG. 2. No. (5) of FIG. 1B are the prior art for the top and the bottom supporting plugs in the yarn spool packaging, whose detail structures are shown as FIG. 3. The assembly drawings of middle plate (FIG. 4), top plate and bottom plate (FIG. 5,6) assembling by the middle (FIG. 2), the top, the bottom supporting plugs (FIG. 3), and the corrugated carton sheet in yarn spool packaging are indicated separately as the number in parenthesis.

The corrugated carton sheet (51) is set with several circular holes whose diameters are approximately equal to the column's outer diameter of top or bottom supporting plug of yarn spools to make the plug can be inserted into the circular hole set on the carton sheet, where in the number of circular holes are varied with the numbers of yarn spools and their supporting plugs, for instance, it is set with 6 circular holes for 6 supporting plugs shown in FIG. 1.

In addition, this corrugated carton sheet (41) is double sides, where in the lower side is the same as general corrugated carton sheet, and on the top layer has several holes with each diameter larger than the outer diameter of the paper tube of the yarn spool, to provide a support for prevention of the collapse of yarn spools.

While recycling the traditional separate plate assembled by supporting plugs and corrugated carton sheet, people often take off FIG. 2's middle supporting plugs, FIG. 3's top supporting plugs and bottom supporting plugs from the corrugated carton sheet (41), (51) as shown in FIG. 4. 5, 6, to ship separately for space consideration. Later on, the reassembly process will be done at factory for reuse. Therefore, this repeated process of taking off and assembling consequently results in the damage and short life of separate plates, and increasing the labor hours.

If we stack together with the prior arts devices of FIG. 4's middle plate, FIG. 5's top plate, and FIG. 6's bottom plate, and then sending to the auto-packaging system at the polyester plant, it will be stacked as FIG. 7A shown, and details enlargement will be shown as FIG. 7B. This type of stacking on the auto-conveyer shipment is unstable, easy to collapse, and space consuming, because the conveyer top will be contacted with the sphere surfaces of supporting plugs.

For this reason, we try to improve the drawback caused by the separation status between supporting plug and separate plate. After certain study, the applicant design a device called "plastic pallet and separator for packaging yarn spools, and apply for a Taiwan's utility model patent, No. 85211559. This device is a construction of plastic separator and pallet, forming in one mold with the supporting plugs of yarn spool, which to be used in package fixing, shipment and storage. It has an insertable supporting plug of yarn spool, therefore, can be mutually inserted up and down while using in stacking, state, and not only save storage and shipment space but also get more steady and prevent collapsing. Moreover, it saves the separately take-off process in recycling use which naturally reduces the labor hour and increase the life-cycle of top, middle and bottom plates.

SUMMARY OF THE INVENTION

It is therefore an object of the present invention to provide a device for supporting yarn spools during package shipment and storage, constructed by plastic pallets and plastic separators comprises the supporting plugs of bobbins and the top or base pallet, the middle separator or the bottom pallet, to combine together as a whole for separating bobbins from each other.

DETAILED DESCRIPTION OF THE INVENTION

Figure 1A:
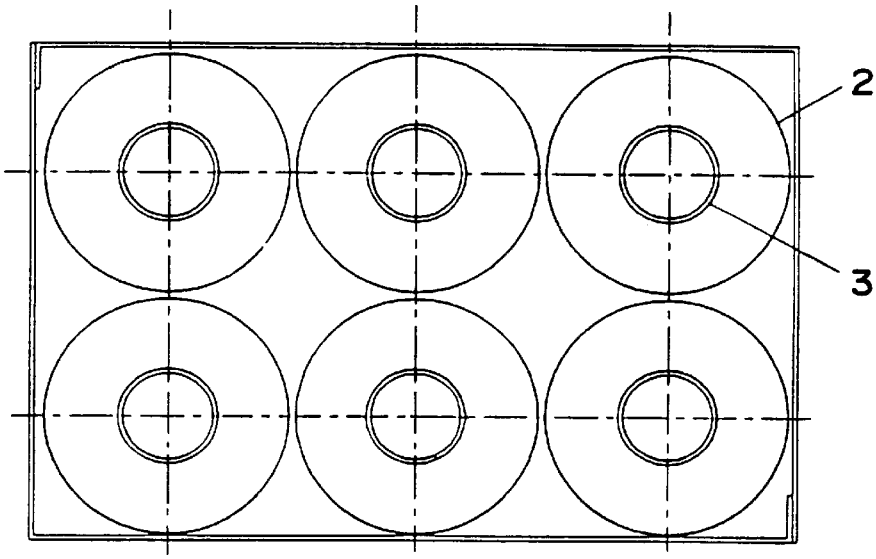
FIG. 1A (PRIOR ART)
FIGS. 1A and 1B are respective top view and side view of the package assembly of the traditional supporting plug and corrugated carton separator.
Figure 8:
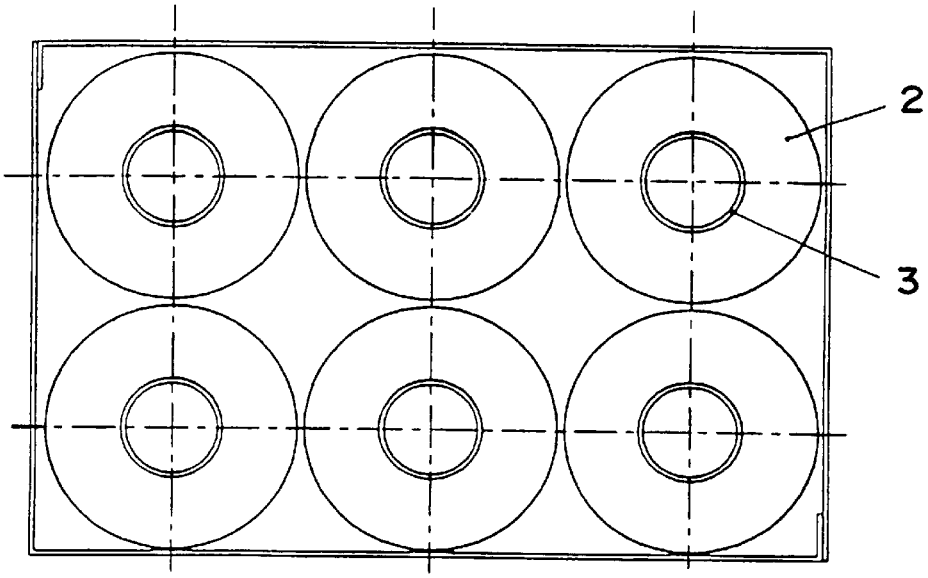
FIG. 8 is a drawing of the present invention with a single molding structure for plastic separator, pallet, and insertable supporting plug.
Figure 8:
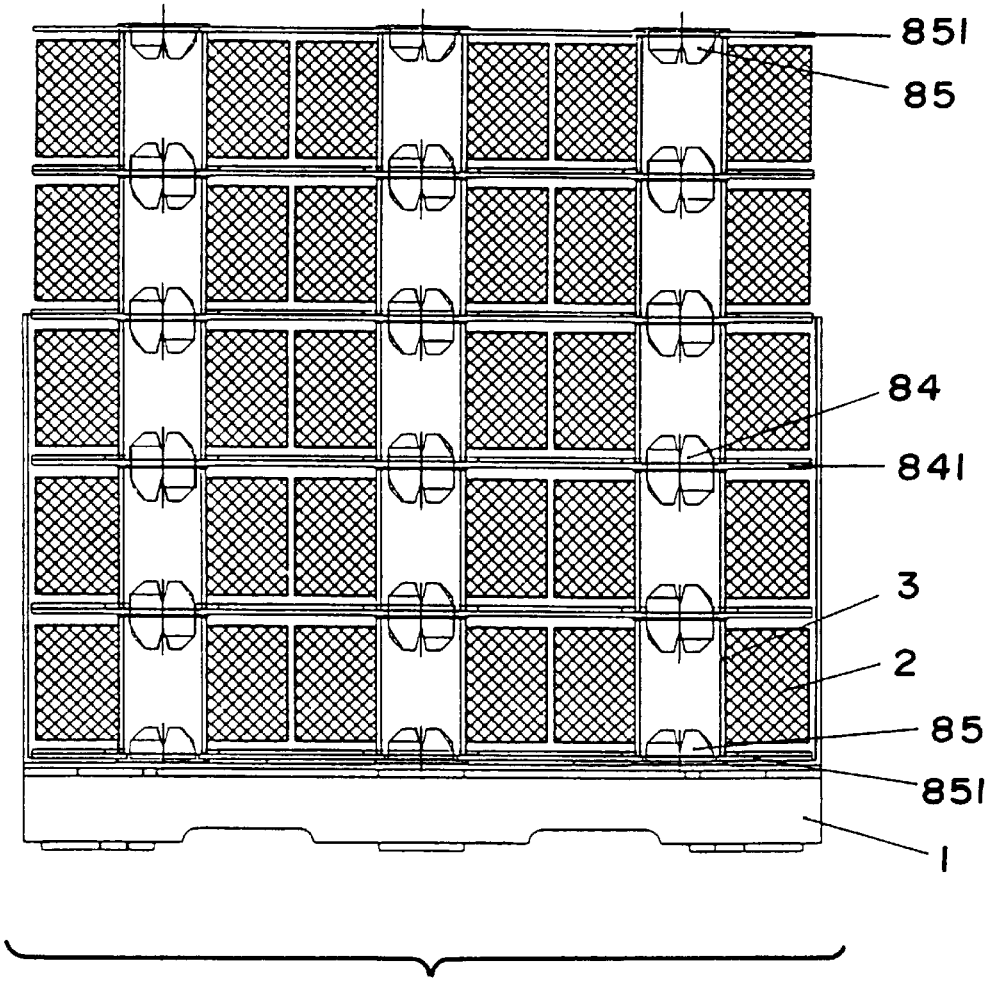

The primary purpose of this invention is to provide a construction of plastic separator and pallet for yarn spool package. This invented device is a construction of the supporting plug of yarn spool, the top, middle, and bottom plates, all with fixing plugs, and together molding in single mold to act as layer separators. (Following will further describe the features of this invention's structure and assembly with reference to accompanying the drawings.) FIG. 8 is a package presentation drawing assembled by the package yarn spool and a single mold forming of plastic separators, pallets and insertable supporting plugs, wherein No. (1), (2), (3) are partly as same as FIG. 1; No.(841), (851) are the middle plate, the top plate, and the bottom plate of this invented single molding plastic separator and the pallets, which are designed differently in structure, assembly mode and material selections, with the design of join ways between No. (4) and No. (5). As we mentioned in the Utility model patent application No.85211559, a supporting plug of being departable for insertion, No. (84) and No. (85) of FIG. 8 is a new structure, and this invention take the above said plug to be plastic molded (such as injection molding, vacuum molding, compression molding, injection-compression molding or low-pressure foaming molding), with middle or top plate, and bottom plate, made of copolymer materials such as PE, PP, PS, PVC. . . . etc., in the meantime, to emphasize that the supporting plug of yarn spool and the separators are molded to be a single construction in the same mold simultaneously. Therefore, this invention has significant advantage, for instance, to avoid wasting labour hour during plugs and plates take-off work for shipment, to avoid the damage caused by take-off work and to increase the times of recycle use, to cost down, and to prevent deformation or damage of the two wings of the supporting plug. It actually is an improved invention of the said Taiwan patent application No. 85211559.

Figure 9A:
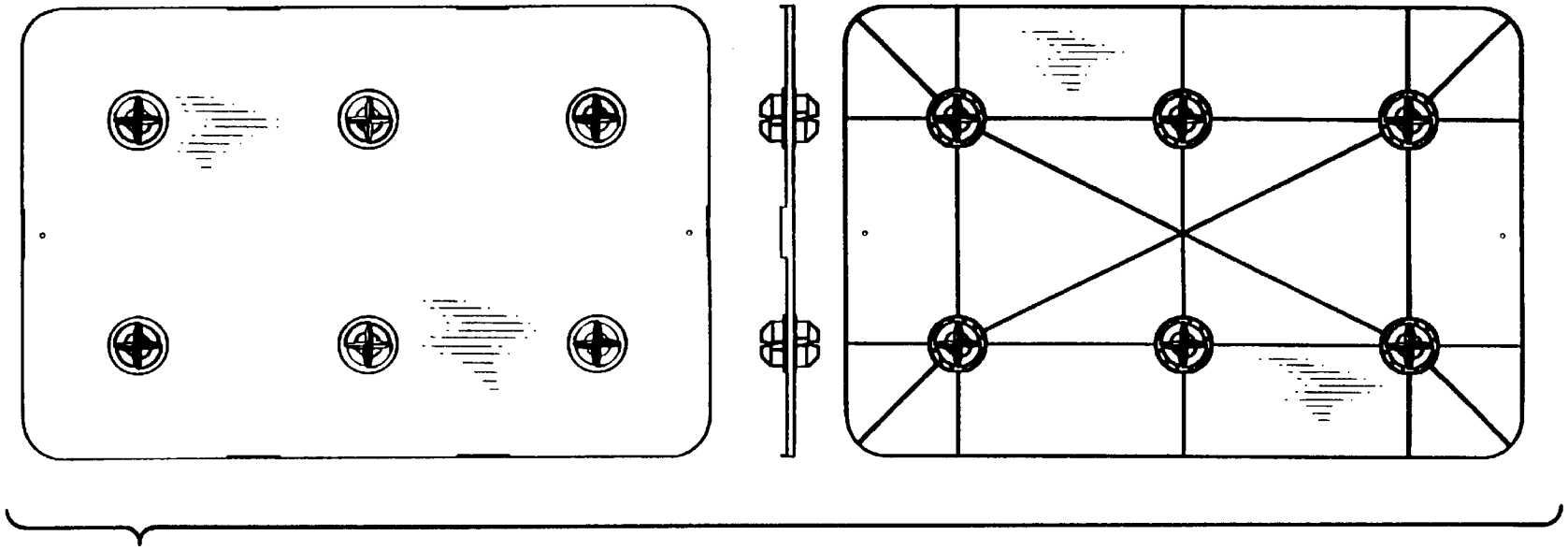
FIG. 9A is a 3-view drawing of the present invention with a single molding structure for plastic separator, pallet, and insertable middle supporting plug.
Figure 9B:
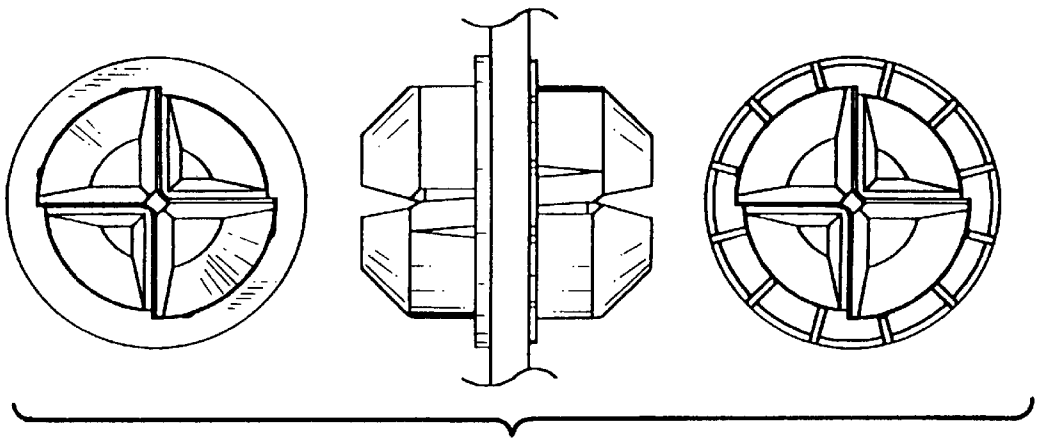
FIG. 9B is a 3-view drawing for the middle insertable plug of this invention.
Figure 11:
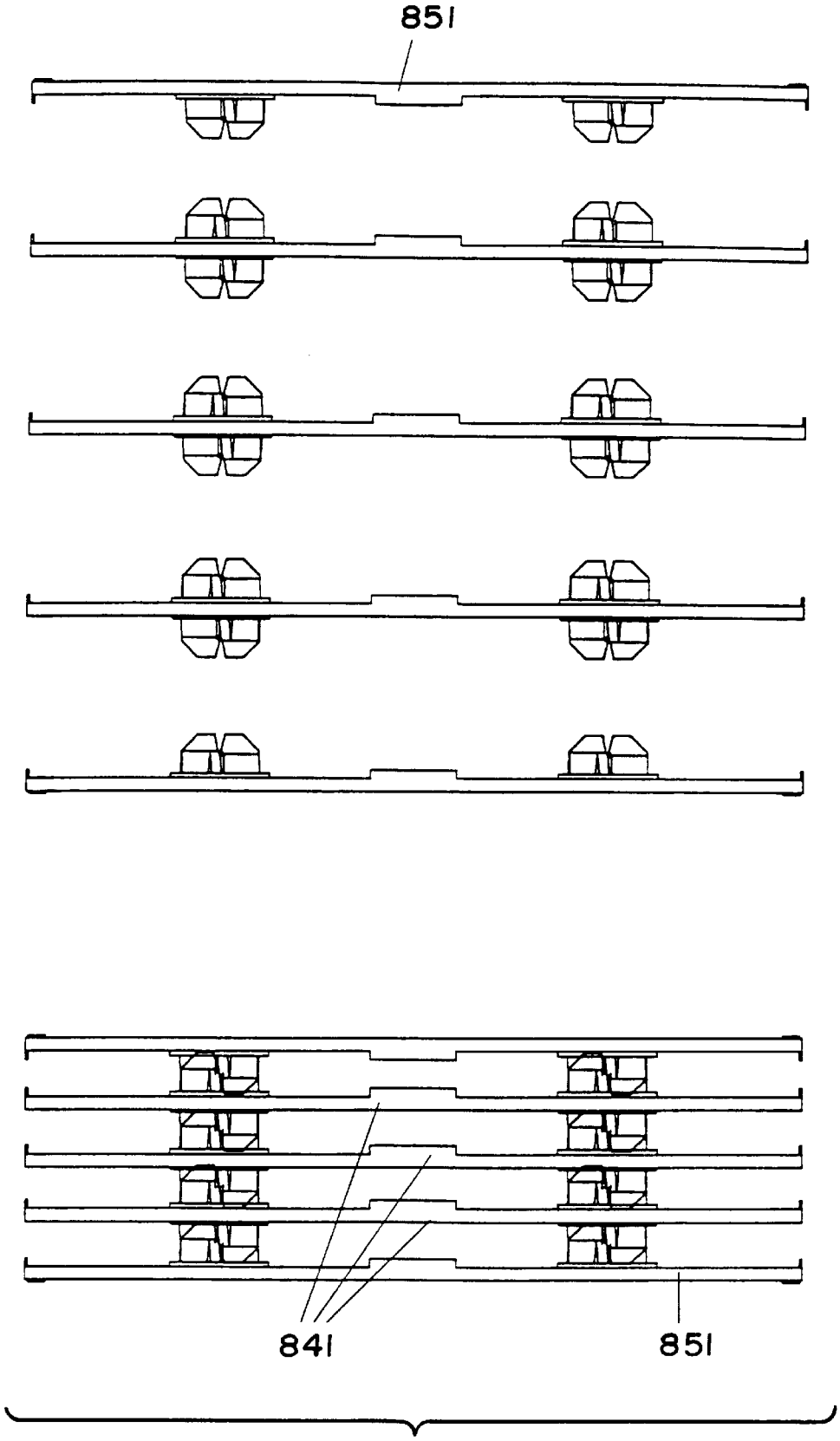
FIG. 11 is a drawing for the stacking of one top plate (51), 3 middle plate (41) and one bottom plate (511) of this invention.

The second purpose of this invention is to provide a construction of plastic separators or pallets for the package of yarn spool, wherein the fixed plug body has molded convex rib set on the symmetric dimensions such as 1st and 3rd, or 2nd and 4th quadrants respectively, to be contacted the inner face of paper tube for the function of supporting. Since the cap body on the 1st and 3rd, or 2nd and 4th quadrants are full of diagonal symmetries, it provides the insertability and stacking stability with no front and back limitation while doing the stack and insertion between the top and the bottom caps. In other words, because top plug, bottom plug (85), middle plug, top cap body and bottom cap body on the surface of plastic separator and pallet have separately set diagonally symmetric convex to be able for mutual stack and insertion as shown in FIG. 11, and can save the shipment and storage space while lining-up, stuff-preparing and recycling, and reduce the labor hour caused by taking-off action between plates and plugs for the inconvenience during stacking and shipping, so as to increase the immobility of pallet stacking and to extend the life-cycle of pallets. This invention is not limited to be used for the top and the bottom paper tubes with the same inner diameters, such as shown in No. (84), (85) and 3-Views drawing in FIG. 9. In fact, it can be used in the yarn spool cover inside with paper tubes whose top rim and bottom rim have different diameters for assembly.

Figure 10A:
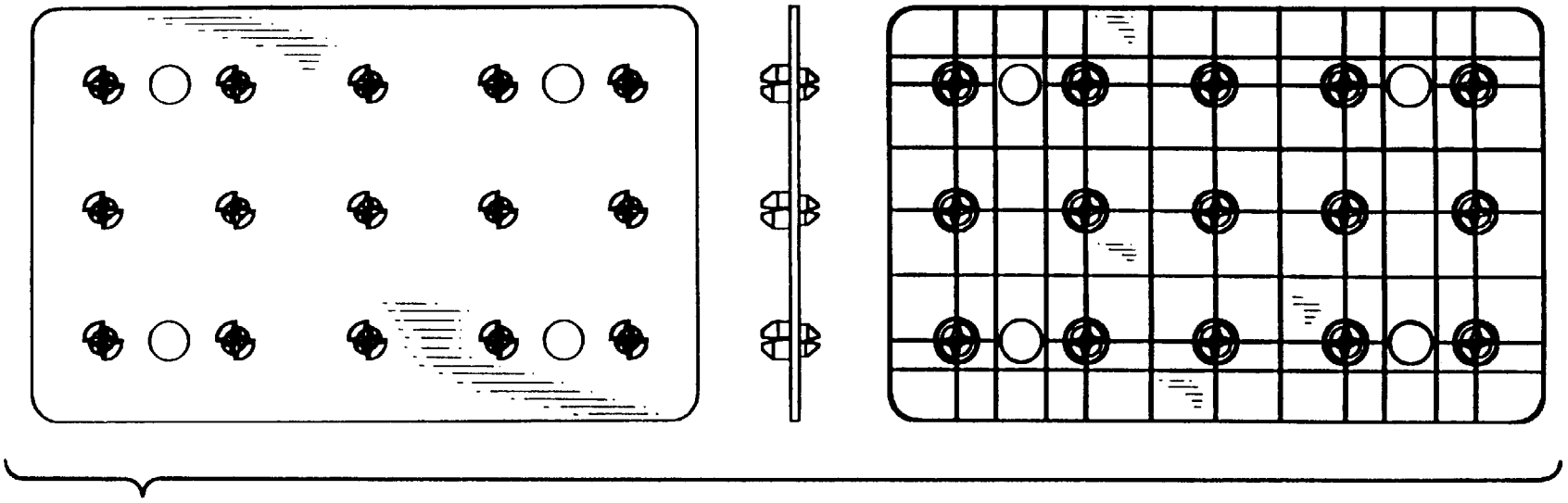
FIG. 10A is a 3-view drawing for this invented single molding structure of plastic separator, pallet and insertable plug with different size in top and bottom cap.
Figure 10B:
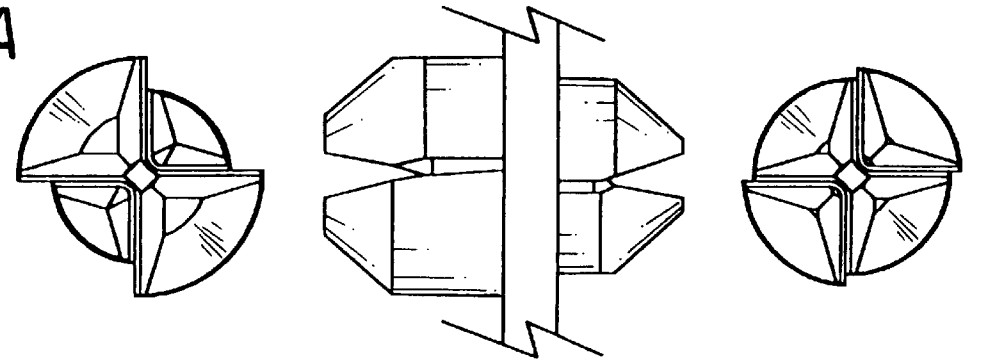
FIG. 10B is a 3-view drawing for this invented insertable plug with different size in top and bottom cap.

This character let the manufacturer have more economic choices during the package of yarn spools with different specifications. Therefore, it develops many top or bottom caps with different sizes but same principle of structures in reference to the structures of No. (84) and (85), which can extend to the inner face of paper tube within the yarn spool center, and thus touch each other for the function of fixing the yarn spool. The 1st and 3rd or the 2nd and 4th diagonal position are still set with symmetrical convex constructions, and therefore, can be crossed insertion and stacking, and meet the feature of more immobility and space saving shown as the 3-view drawing in FIG. 10.

The third purpose of this invention is to provide a construction of plastic separators, and pallets in packaging the yarn spool, where in the small holes and defensive wall located on the separator's surface for fixing and positioning the corrugated carton sheets. In reference to drawings, here will explain the other feature of this invention.

Figure 4:
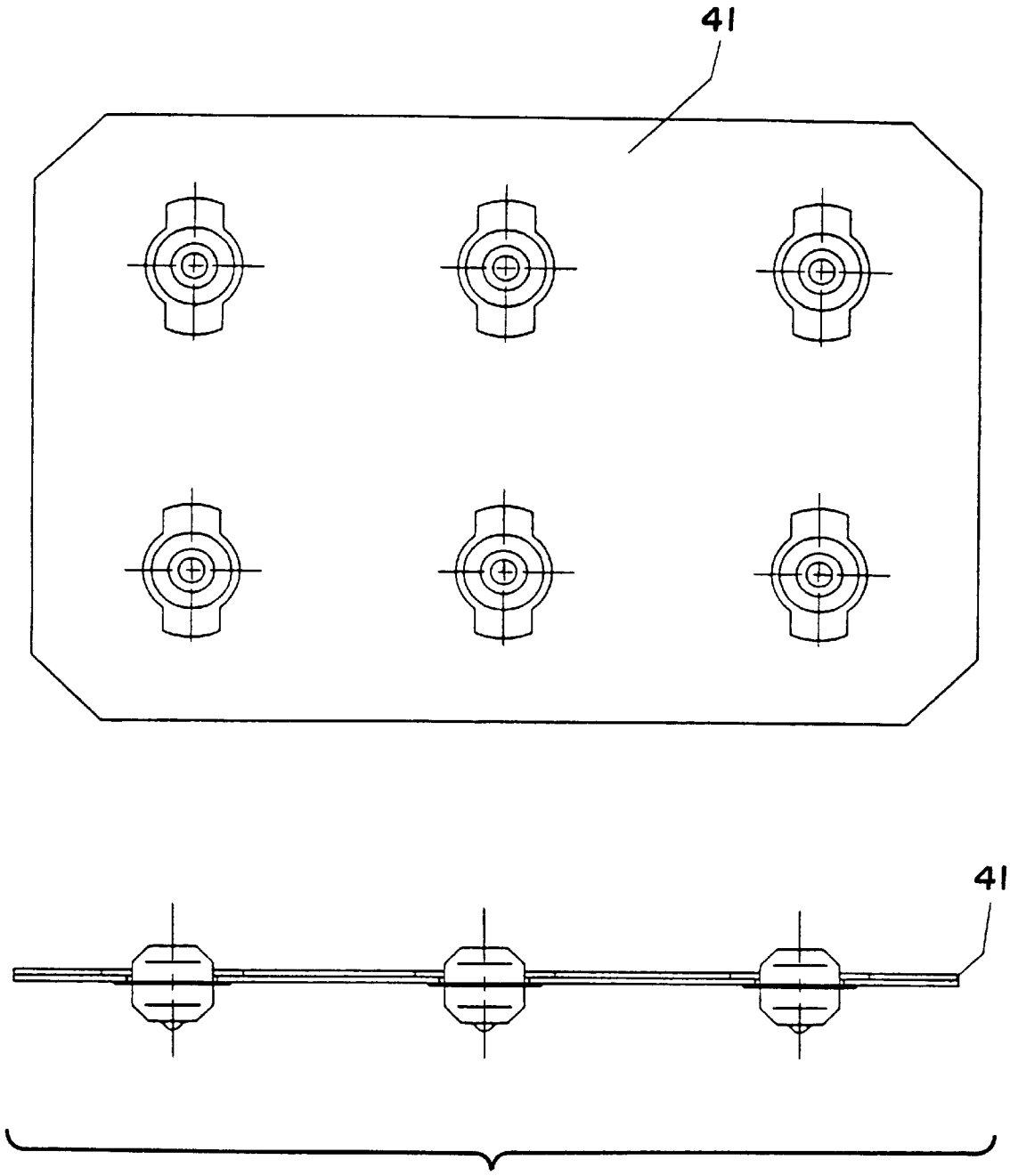
FIG. 4 (PRIOR ART)
FIG. 4 is a top view and side view of the assembly of middle yarn spool's plug and corrugated carton sheet.
Figure 5:
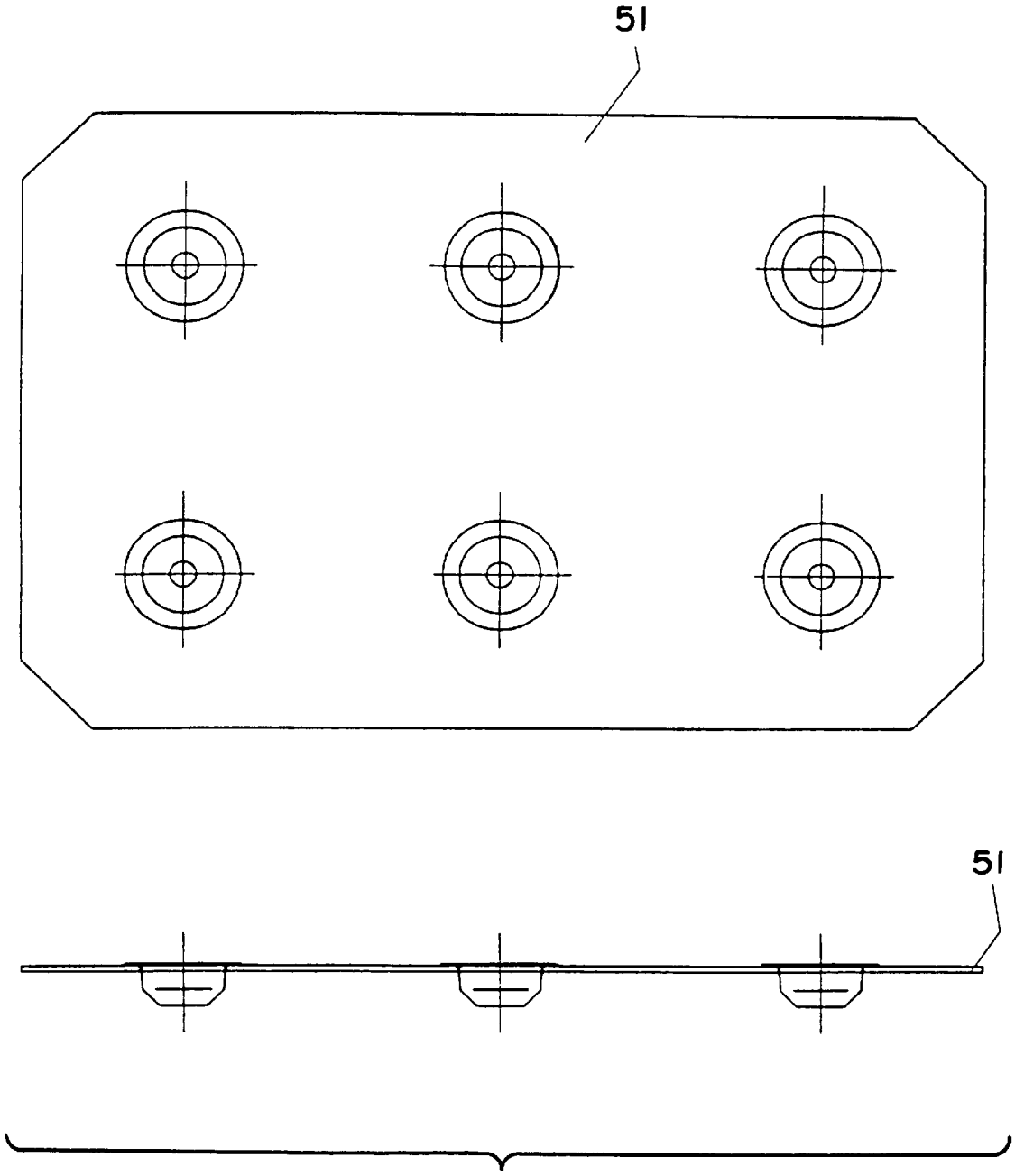
FIG. 5 (PRIOR ART)
FIG. 5 is a top view and side view of the top plate after being assembled by top yarn spool's plug and corrugated carton sheet.
Figure 6:
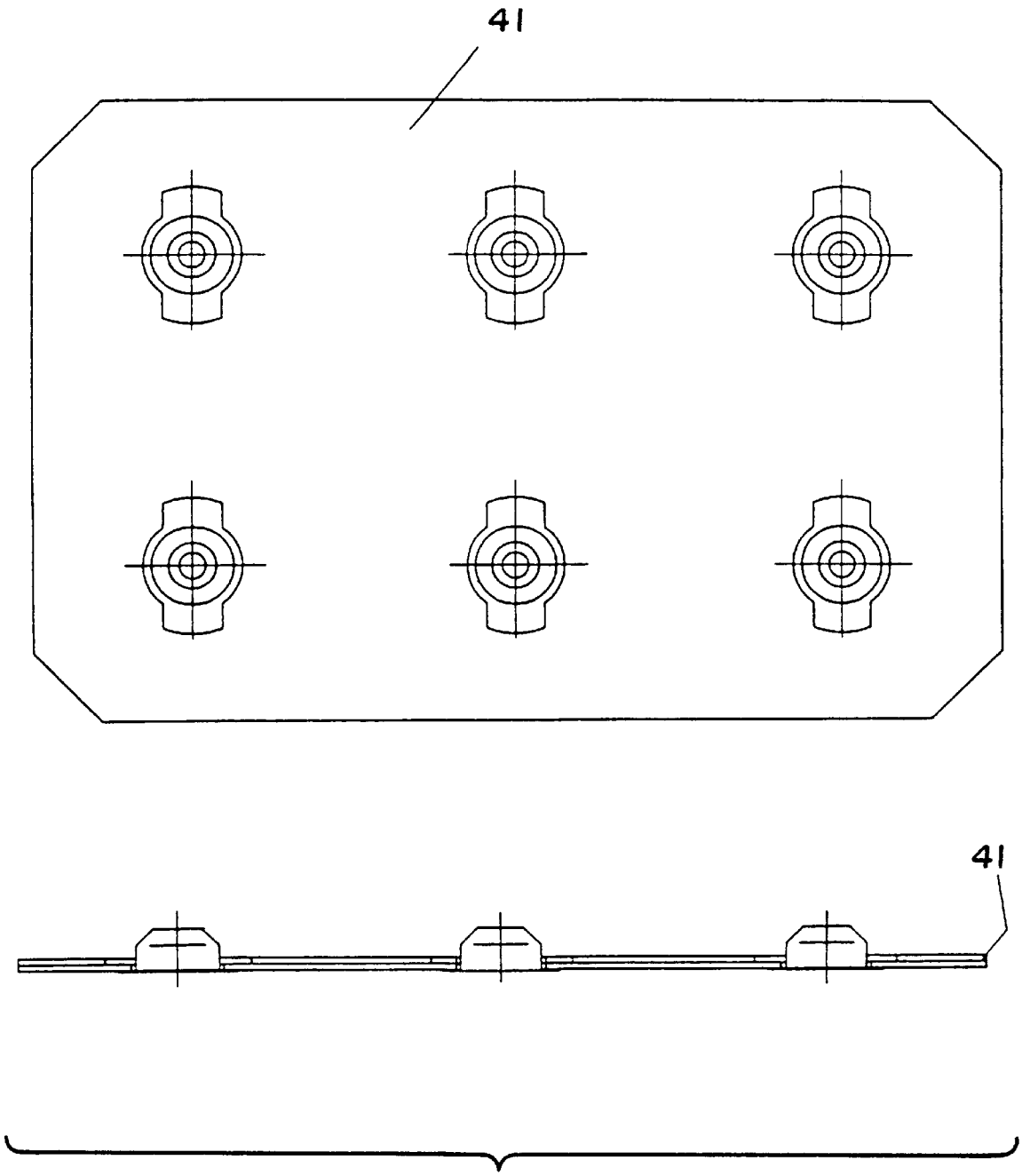
FIG. 6 (PRIOR ART)
FIG. 6 is a top view and side view of the bottom plate after being assembled by bottom yarn spool's plug and corrugated carton sheet.
Figure 12:
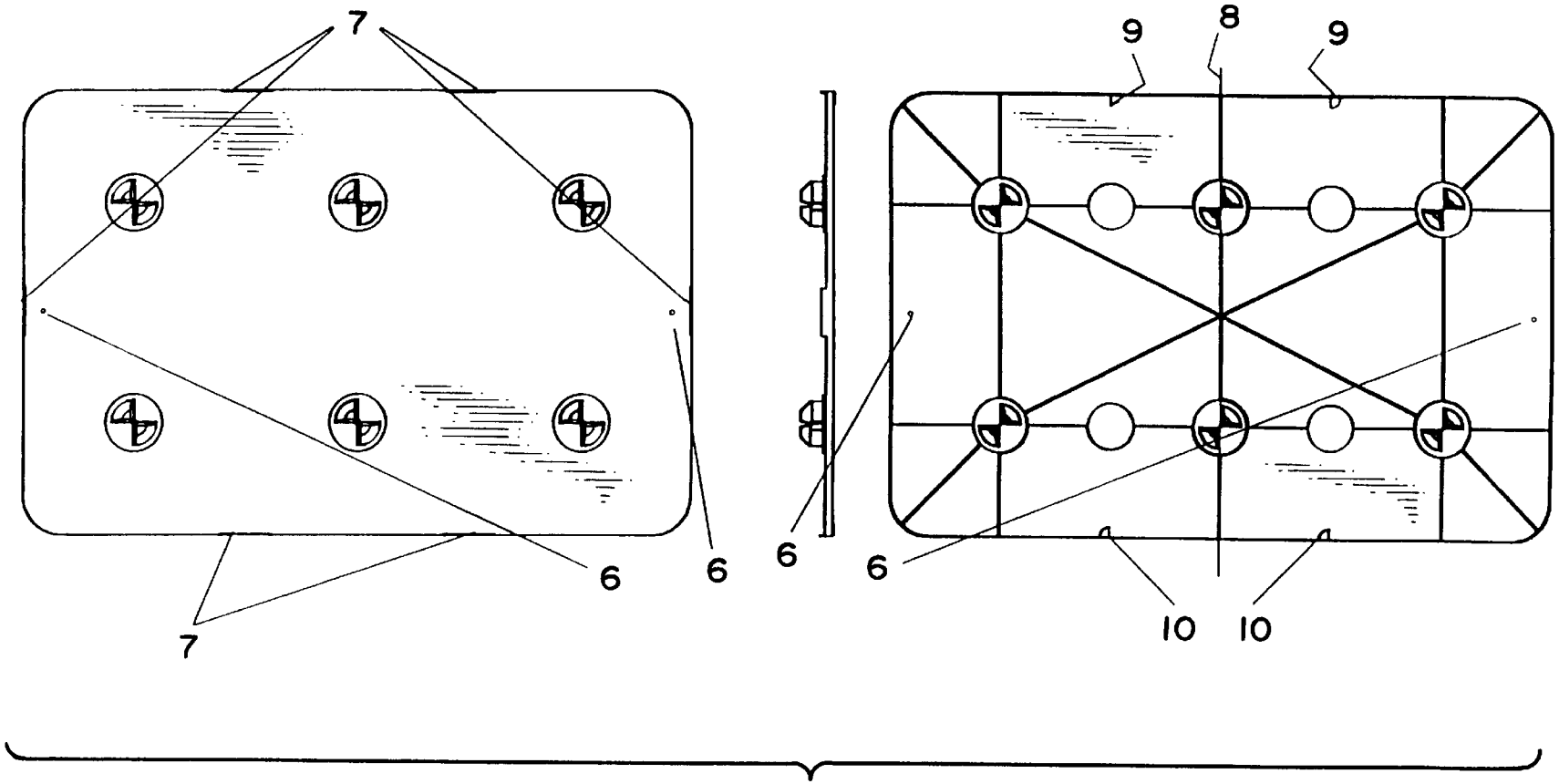
FIG. 12 is a 3-view drawing for this invented single molding structure of plastic separator, pallet, the top and the bottom plug of insertable type.

FIG. 12 is a 3 view drawings of this invented construction of plastic separation and pallets. Because the yarn spool product weighs approximately 25 kg each and the area of core wound yarn will reach above 1250 $cm^2$, its force of fastening is insufficient if only depends on winding of the central paper tube. To resolve this problem, the traditional way is to increase a layer of corrugated carton sheet (41) like that in FIG. 4 and FIG. 6, to be a double sides corrugated carton sheet, wherein one layer functions the same as FIG. 5's corrugated carton sheet (51) for fixing the supporting plug of yarn spool (4) or (5), and over it, laminating a corrugated carton sheet with a hole diameter larger than the outer diameter of paper tube of yarn spool, to keep the bobbins from collapse. This invention also has similar structure for solving above problem. It sets a small hole penetrating the separator, to be fastened with the metal wire, plastic rope or fasten belt while increasing a corrugated carton sheet layer on the surface of plastic separators and pallets, to prevent the departing of corrugated carton sheet, and the number of small holes could be increased if it is required for the fastening function. In addition, it adds several parts of defensive walls (7) which is a little higher than the thickness of single corrugated carton sheet, to be positioned accurately for preventing surface damage caused by sliding.

With the small holes (6) penetrating the pallet body for fixing the extra layer of corrugated carton sheet, and the edge rib on the surface of the body periphery for fixing the defensive wall (7) of the corrugated carton sheet, it can prevent the surface damage caused during the package and shipment process.

Figure 7A:
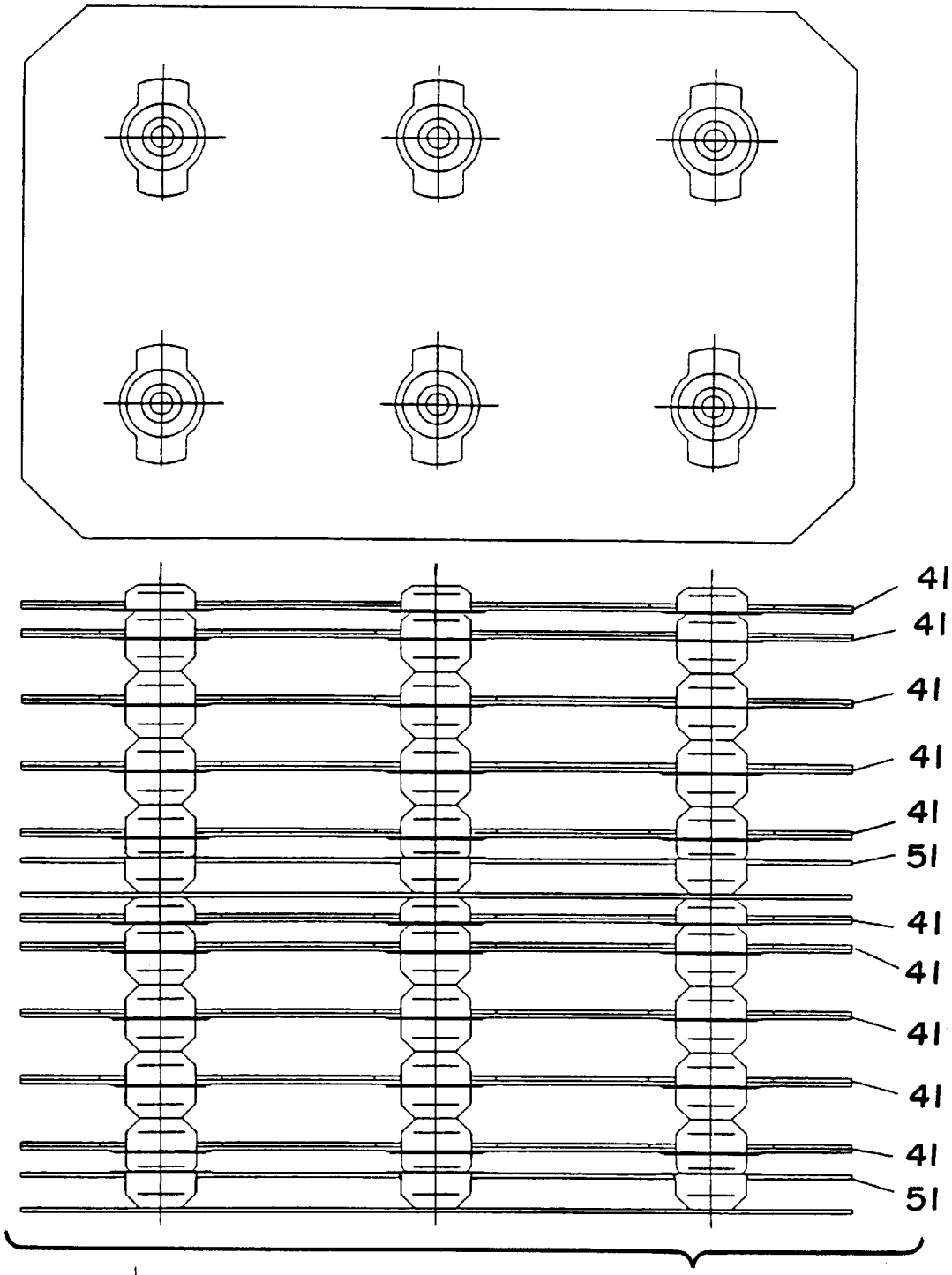
FIG. 7A (PRIOR ART)
FIG. 7A is a drawing for the stacking of traditional middle plate, top plate and bottom plate.
Figure 7B:
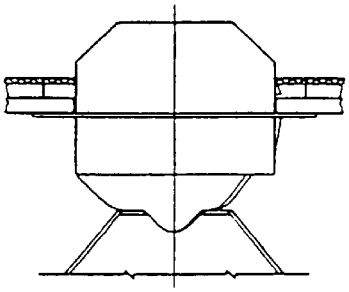
FIG. 7B (PRIOR ART)
FIG. 7B is a drawing for the stacking of traditional top plug, middle plug and bottom plug.

The 4th purpose of this invention is to provide a construction of plastic separator and pallet for package, shipment and storage, wherein, to resolve the drawback of sliding problem caused by collision and motion on the smooth surface of the pallet back face while stacking the pallets on the cart and laying on the auto-conveyer for shipment shown in FIG. 7A, this invention has convex insertion points (9,10) on each side with same size and direction, positioned on the same distance from the opposite long side of the smooth back face of plastic separator to their center line (8), and the same size but reverse direction points for insertion are set on the opposite long side to ensure that it can be inserted closely, while stacking the smooth back of plastic separator and pallet in the condition of 180 rotation. FIG. 12 shows that this invention employs ¼ circle design to be inserted tightly to form a ½ circle in assembling state for preventing sliding of plastic separators and pallets toward any direction. Besides, the same function could be reached by changing the shape and size of convex objects. In other words, in order to prevent for anti-slide. Any change of form and dimension of insertion point should be included in the scope of this invention.

Figure 1B:
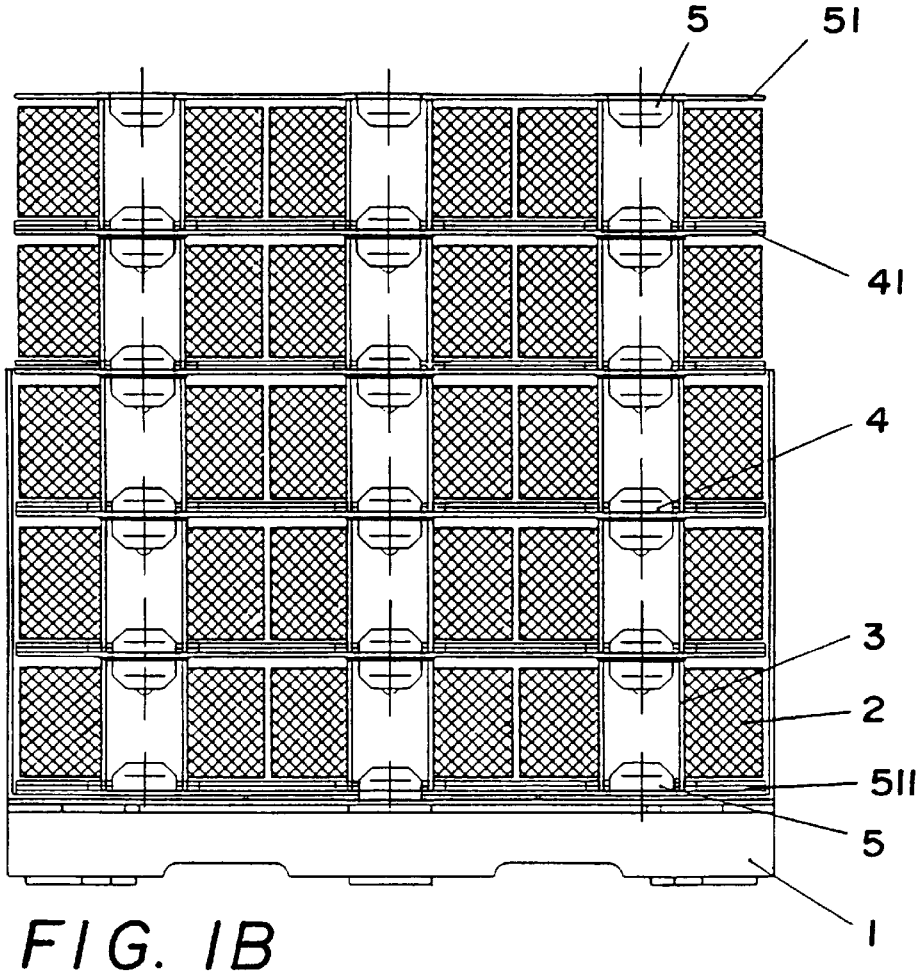
FIG. 1B (PRIOR ART)
Figure 2A:
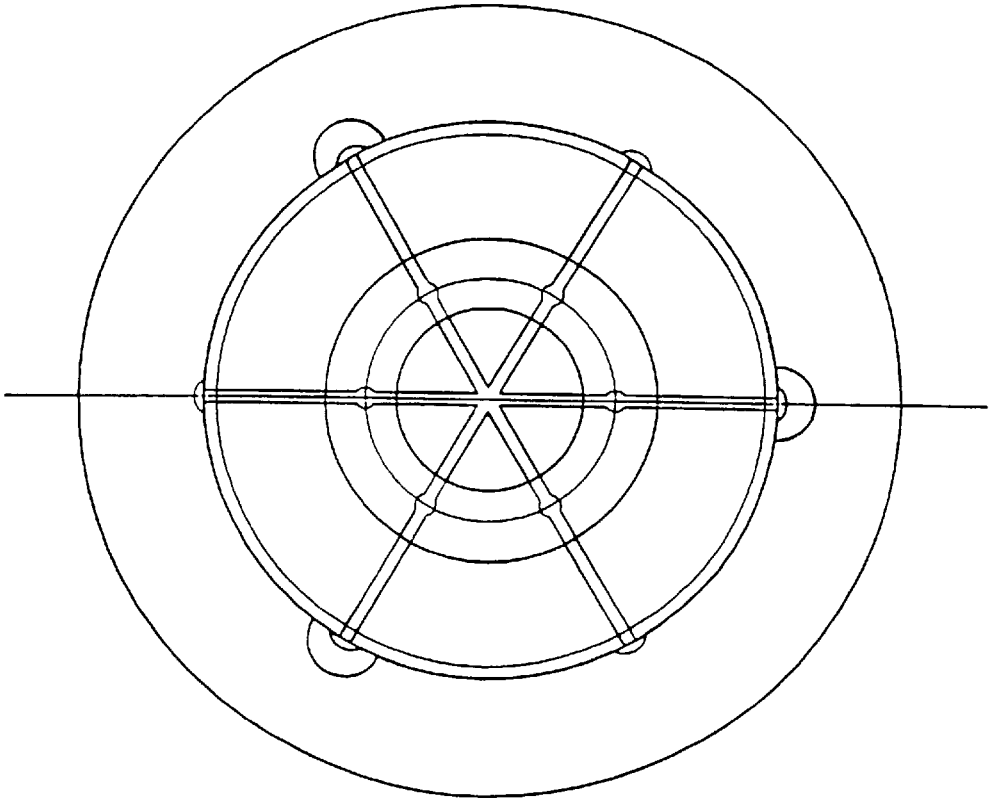
FIG. 2A (PRIOR ART)
FIGS. 2A and 2B are respective top view and side view of traditional supporting plug of yarn spool.
Figure 2B:
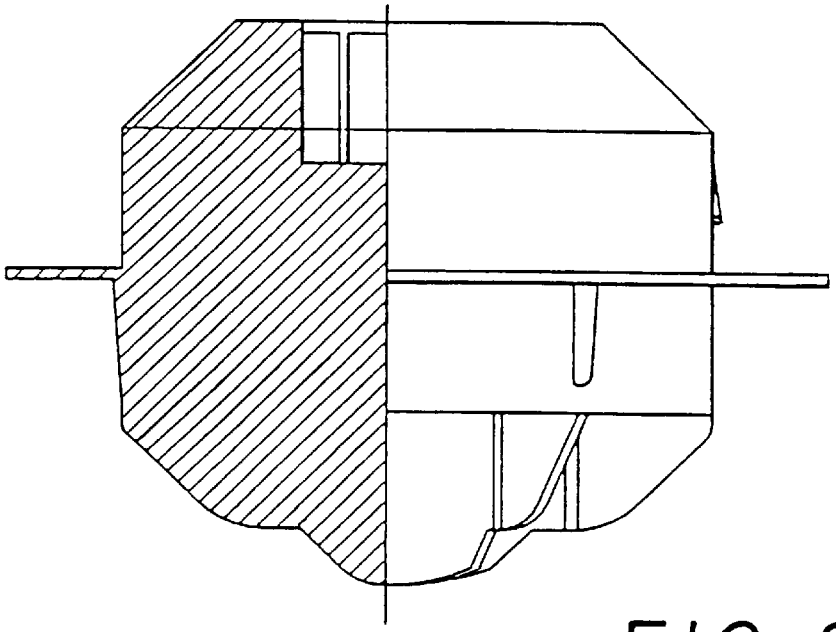
FIG. 2B (PRIOR ART)
Figure 3A:
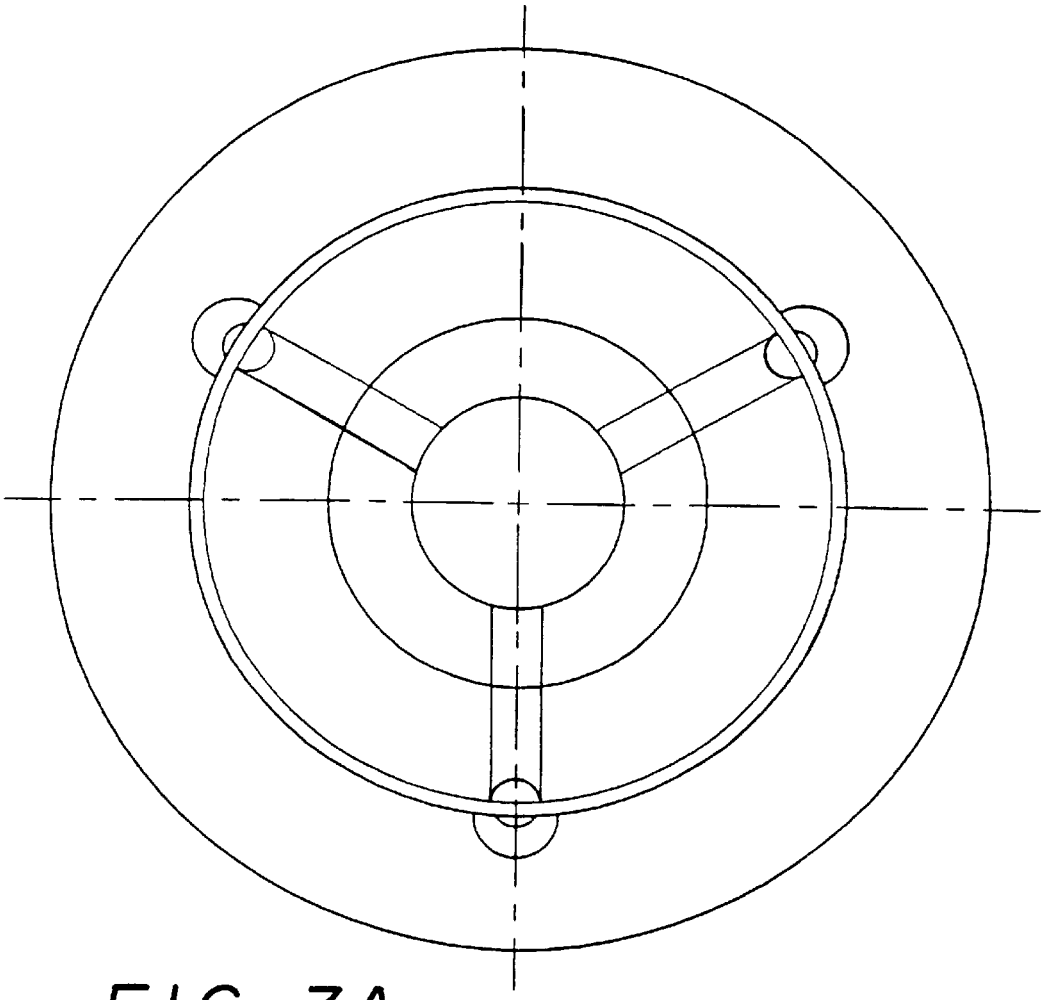
FIG. 3A (PRIOR ART)
FIGS. 3A and 3B are respective top view and side view of traditional top and bottom supporting plugs of yarn spool.
Figure 3B:
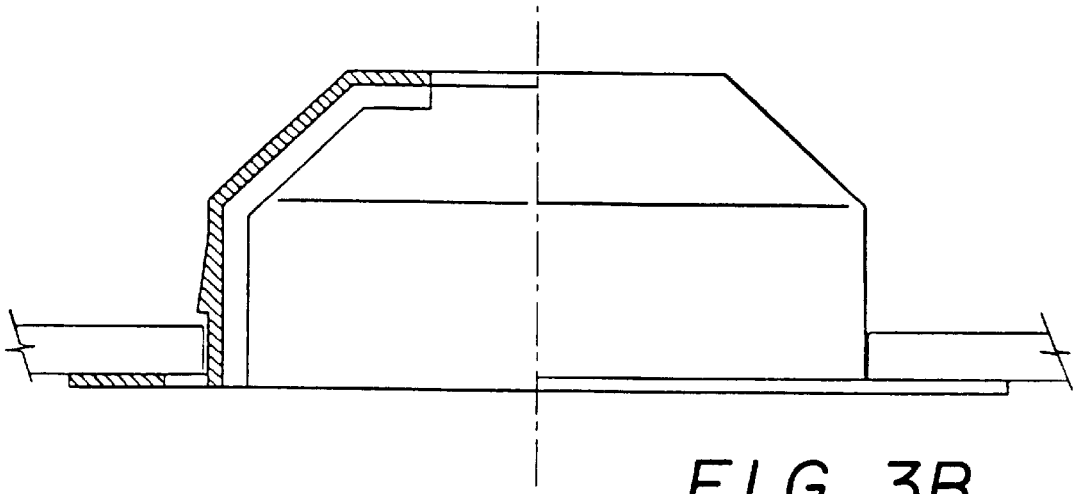
FIG. 3B (PRIOR ART)

The 5th purpose of this invention is to provide a construction of plastic separator and pallet, where in the traditional ways of package such as shown in FIG. 1B using the wood pallet for the shipment of the carton box containing a top plate (51), a bottom plate (511) and several middle plates (41) and multi-layers yarn spools, and the non-carton package of pallets and yarn spool plug, both will be improved in this invention. We use the single molding of yarn spool with climate-resistant, high load capacity, fragment-resistant and smooth surface to replace of the traditional separately package of corrugated carton sheet, yarn spool plug and wooden pallet, to reduce the cost of cartons, wooden pallets and shipment.

Figure 13A:
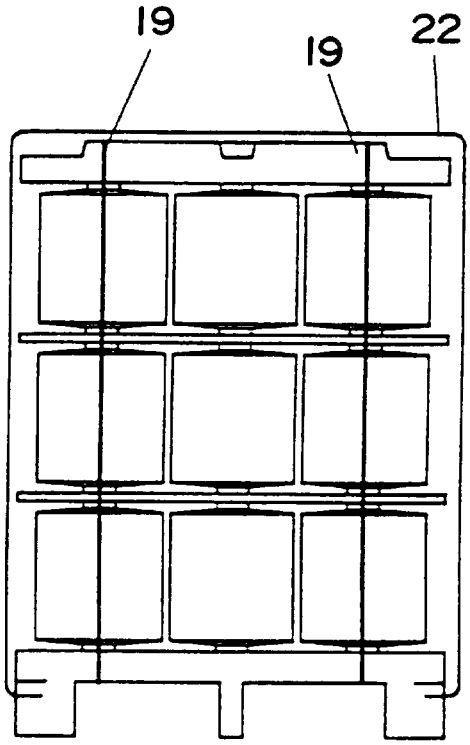
FIG. 13A is a side view assembly package for this invented single molding structure of plastic separator, pallet and insertable plug.
Figure 13B:
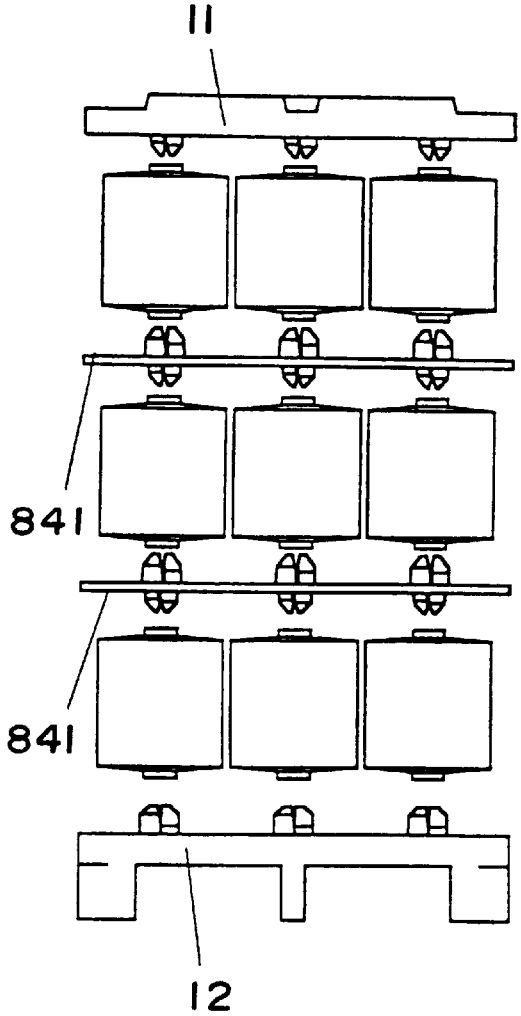
FIG. 13B is an exploded view of FIG. 13A.

To further explain the feature, here refer to FIG. 13, which is the package presentation drawing of the single molding construction of plastic separator, pallet and insertable supporting plug, and its assembly package with yarn spool, wherein No. (11) is the minor change form of top plate (851) in FIG. 8, named top pallet to distinguish with the top plate: No. (841) is the same structure as that No. (841) in FIG. 8; No. (12) is the combination of bottom plate (851) and pallet (1) in FIG. 8. In the same situation, it is called bottom pallet to indicate that its novelty is different from that of pallet (1).

Figure 14:
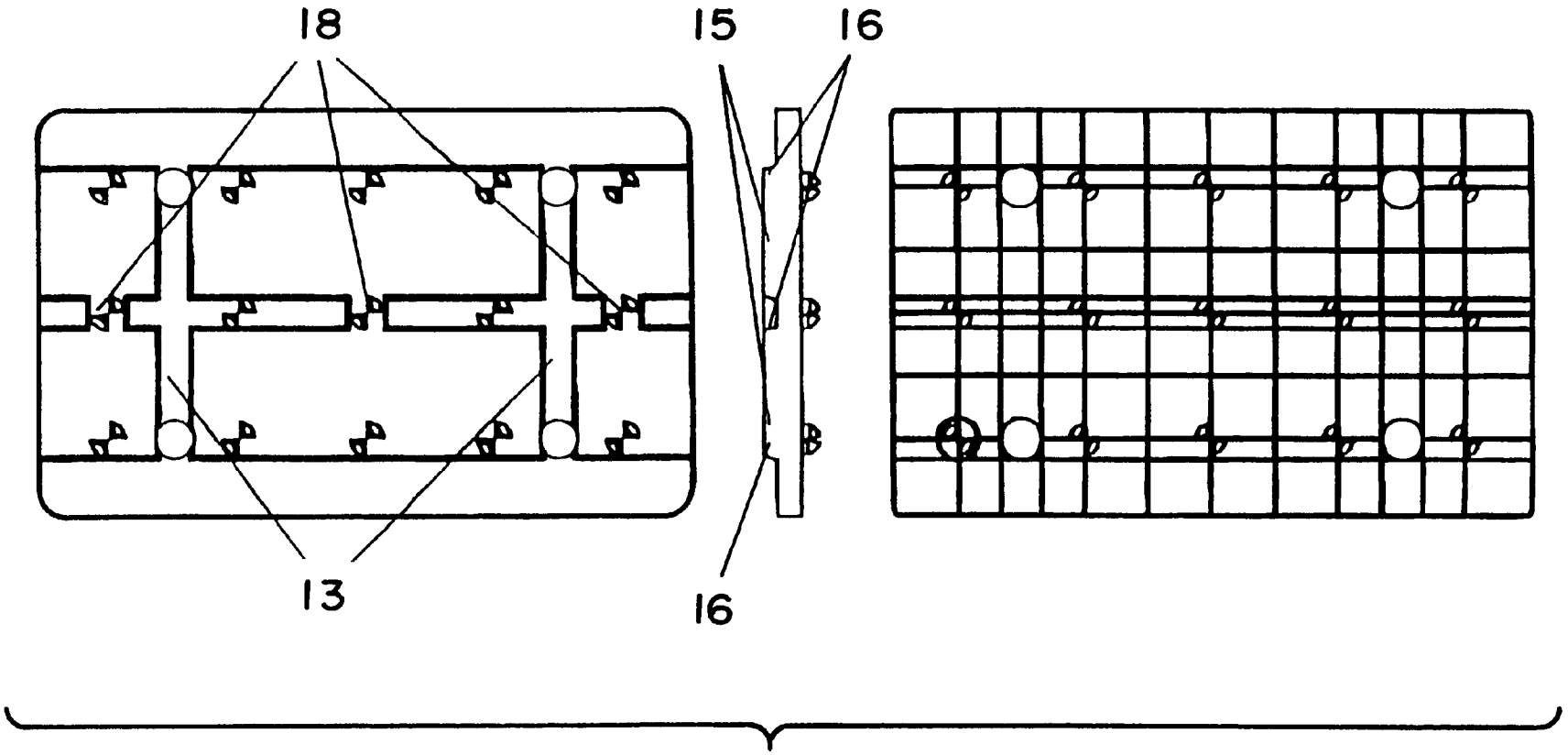
FIG. 14 is a 3-view drawing for this invented single molding structure of plastic top pallet and insertable plug.
Figure 15A:
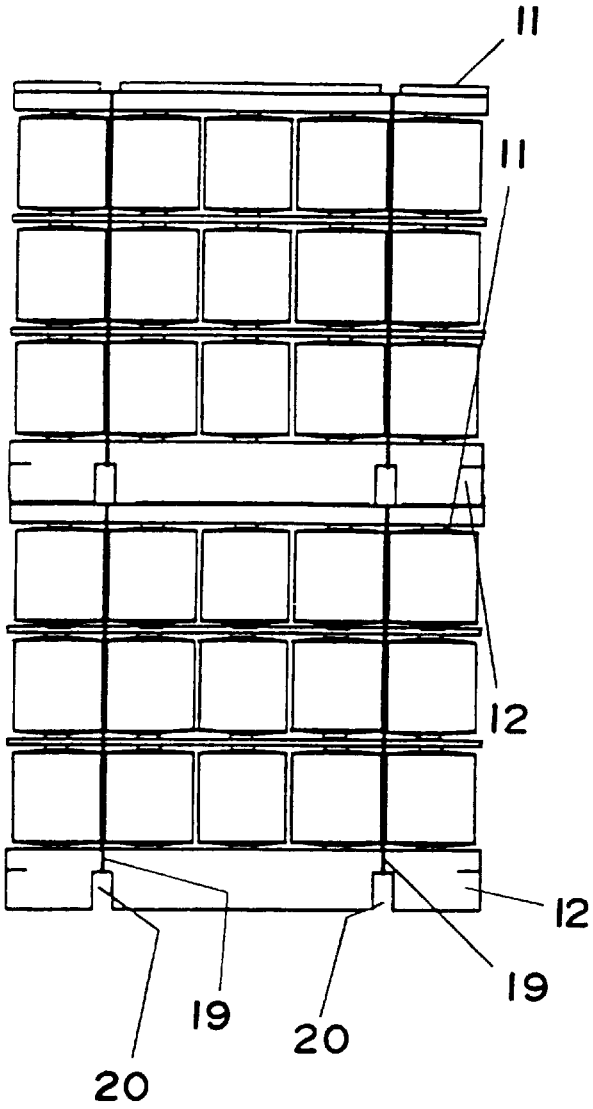
FIG. 15A is a presentation drawing of side-view for the package of two or more layers' stacking of this single molding structure of plastic separator, pallet and insertable plug.
Figure 15B:
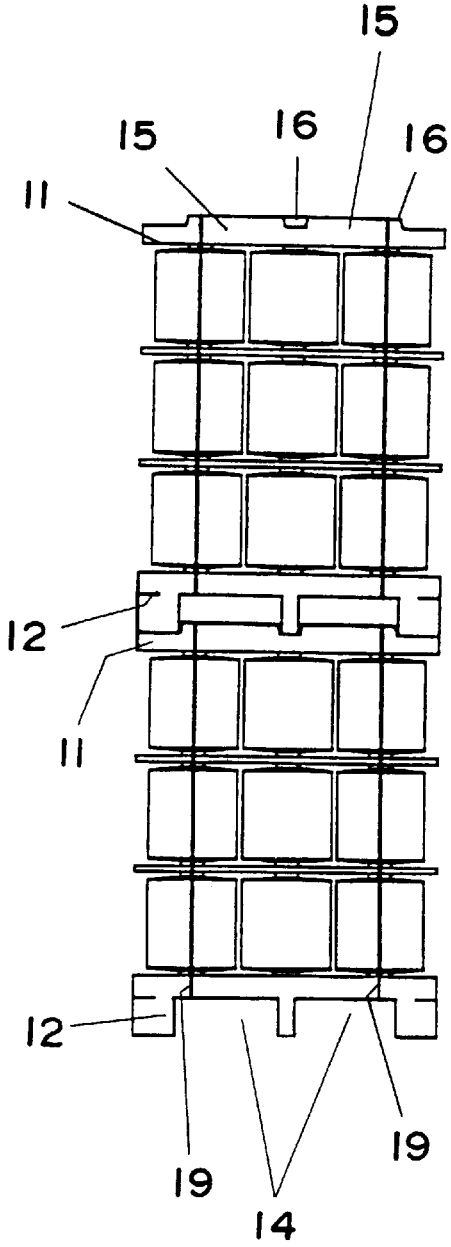
FIG. 15B is a presentation drawing of front-view for the package of 2 or more layers' stacking of the single molding structure of plastic separator, pallet and insertable plug.

The sixth purpose of this invention is to provide a construction of plastic separator and pallet for yarn spool packaging, where in FIG. 14 is the 3-view drawing of top plate. Although this invention owns many new concepts, however, it still require some other package modes such as shown in FIG. 15's drawing, using the package rope (19) to extend from top pallet to bottom pallet for replacing of the fiction of carton for package fixing. Besides, this package mode also need to consider the number of layers to avoid the forks of forklift truck could directly touch with the rope causing grinding damage, and results in the rope fracture and collapse. This invention will set a deep groove (13) with the width larger than the rope's and the same direction as the package's, to ensure the packing rope can contact tightly with the top plate so as to avoid to be damaged by the forks, and therefore, can keep the package well.

The 7th purpose of this invention is to provide a construction of plastic separator and pallet for packing yarn spool, wherein, in order to keep the stability and insertabity for stacking 2 or more layer packages as FIG. 15, and preventing the danger of tilt and collapse by stacking too high, this invention's top pallet is formed to match the bottom pallet design, and set convex (15) rib a little smaller than the space length between bottom pallet feet (14) which acts for forklift or man trailer forking, so to have good condition of insertion and stability, in the meatime, providing sloper angle (16) for convenience of mutual insertion in 2 layer packing and stacking and saving the time of adjustment and locating. Moreover, the convex rib (15) also need to consider that the height from the space between bottom pallet feet (14) to the convex rib must be long enough for the forklift's fork inserting totally to ensure the stability of shipment. That is said, the height must be limited for the shipping requirement of forklift.

In addition, this invention have some open space (17), due to the limitation caused by the molding plug (85) of yarn spool on the top of bottom pallet's (12) middle feet and by the molding mode to the back area of the said middle feet, the upper layer thus could be shifted towards Y axis direction. Here we set several convex points (18) for location, on the top face of top pallet in the aforesaid space (17) while the bottom pallet (12) stacking on the top pallet. In the same situation, the convex points must have slope and be smaller than the space between bottom pallet's middle feet, to be easy for laying down and picking up in shipment, and resulting the multi point insertion to ensure the stacking stability preventing any package shiftment toward X or Y axis direction.

Figure 16:
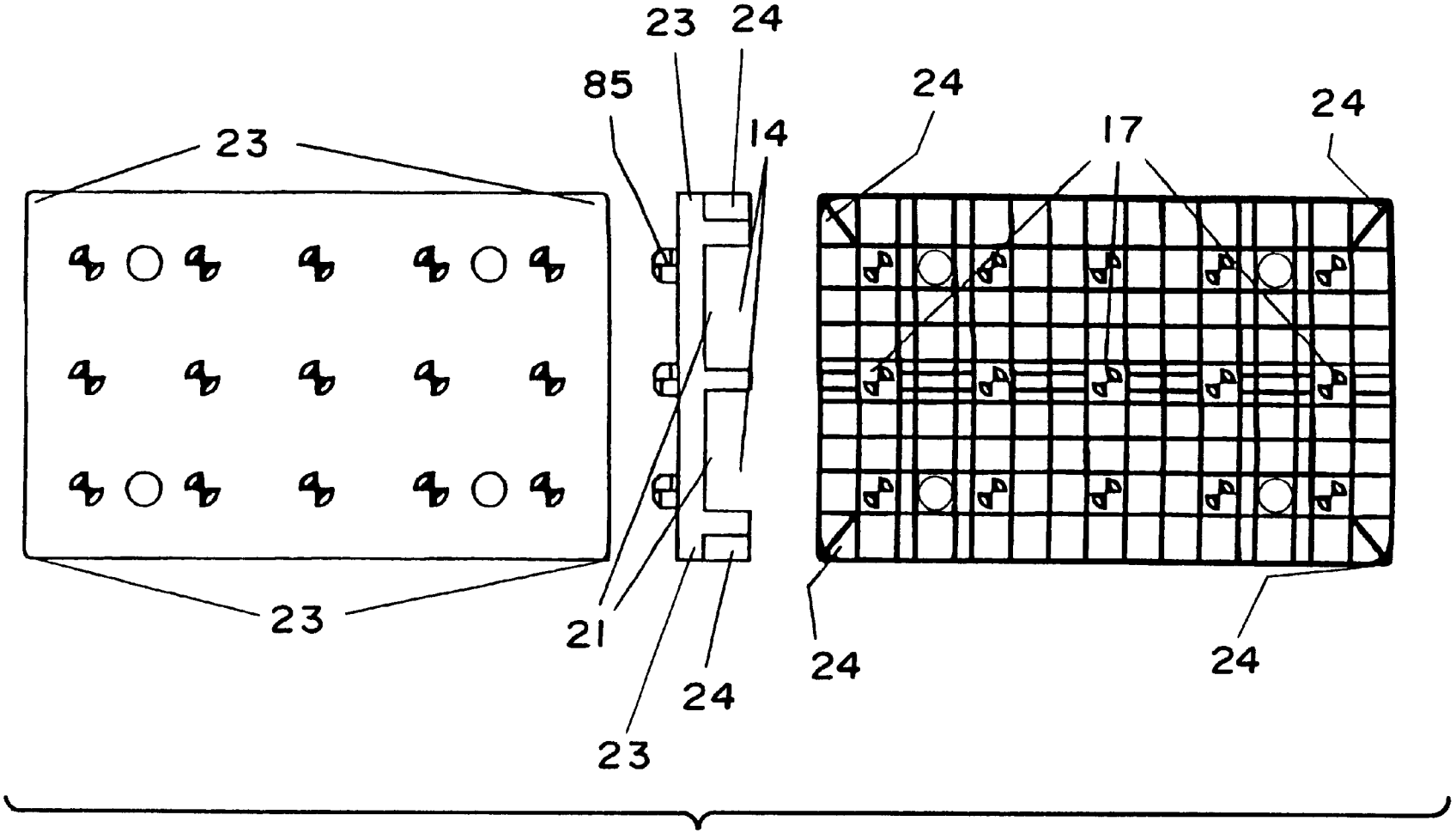
FIG. 16 is a 3-view drawing for this invented single molding structure of plastic bottom pallet and insertable plug.

The 8th purpose of this invention is to provide a construction of plastic separator and pallet for packing yarn spools, wherein. FIG. 16 is the 3-view drawing of this invented bottom pallet. Like mentioned before, the bottom pallet is designed for increasing life and reducing labour force to replace of the traditional bottom plate (511) and pallet (1) being different materials and separate entities. Although this invention can be free from the use of carton and wooden pallet in shipment, it still need packing rope (19) or film for package to ensure the stability and integrity, especially, Using rope to extend from the top pallet to bottom pallet can avoid the direct contact and friction between rope and forklift's fork which may result the fracture and package wear damage and thus collape.

This invention also sets on packing place a deep groove (20) wider than rope and is in the same direction of packing to put the rope close tightly to the upper rim (21) of bottom pallet's back face or even merge in the back face to totally free from direct contact or friction between rope and liftfork to keep the integrity of package.

The 9th purpose of this invention is to provide a construction of plastic separator and pallet for packing yarn spool, wherein the fixing of wrapping film is a creative idea. It skips off traditional carton and replaces it with packing rope and wrapping film. Therefore, when we adopt the package assembly as FIG. 15, it needs to take wrapping films (22) to the top pallet to cover the whole yarn spool, outer rim of middle plate and extending those to the bottom pallet for ending up the packing work, to keep off dust or stain caused by lacking of the carton protection. Because the curve from the bottom pallets (12) surface to the 4 corner upper rims (23) is larger than that from upper rims to the lower rims (24) of ground corners, it constitutes a projecting structure on the said corner which can be easily wound by the wrapping film extended from the top pallet to bottom pallet, and ensure the package will be tightly bound and integral.

In summary, because the insertable yarn spool plug and plastic separator are formed in the single mold, it can improve the traditional way in the storage, shipment, and package of the yarn spools and the pallets, and therefore be more efficiency in shipment space and time, reduce the cost of labour hour, replacing cartons and wooden pallets. In addition, this invention propose a more economic way of package that is, to make the plastic separator and pallet in one mold, and to pack with the low cost packing rope and the wrapping film.

What is claimed is:

1. A construction for the packaging of plastic separators, comprising:

top, middle and bottom plates formed of single plastic moldings, each of the plates having support plugs configured for positioning one or more yarn spools sandwiched between the top plate and the middle plate, the top plate and the bottom plate, or the middle plate and the bottom plate;

wrapping film (22) configured to cover the yarn spools sandwiched between the plates;

the top and bottom plates each including deep grooves (13, 20);

packaging rope extending along the grooves for securing the yarn spools between the plate, said grooves having widths larger than that of the packaging rope;

the bottom plate including at least four corners with upper rims (23) and bottom rims (24), the upper rims (23) projecting further than the bottom rims (24); and the rims configured as fixing parts for the wrapping film (22) that extends from the top plate to the bottom plate.

* * * * *